US010406388B2

(12) United States Patent
Holman

(10) Patent No.: US 10,406,388 B2
(45) Date of Patent: Sep. 10, 2019

(54) SELF-CONTAINED BREATHING APPARATUS WRAP SYSTEM

(71) Applicant: Kimburly Holman, Provo, UT (US)

(72) Inventor: Kimburly Holman, Provo, UT (US)

( * ) Notice: Subject to any disclaimer, the term of this patent is extended or adjusted under 35 U.S.C. 154(b) by 112 days.

(21) Appl. No.: 15/870,688

(22) Filed: Jan. 12, 2018

(65) Prior Publication Data

US 2018/0193679 A1 Jul. 12, 2018

Related U.S. Application Data

(60) Provisional application No. 62/445,535, filed on Jan. 12, 2017.

(51) Int. Cl.

| | |
|---|---|
| ***A41D 13/01*** | (2006.01) |
| ***A62B 25/00*** | (2006.01) |
| ***A62B 35/00*** | (2006.01) |
| ***A45F 3/12*** | (2006.01) |
| ***A62B 7/02*** | (2006.01) |
| *A62B 17/00* | (2006.01) |
| *G08B 5/00* | (2006.01) |

(52) U.S. Cl.

CPC ..... *A62B 25/00* (2013.01); *A41D 13/01* (2013.01); *A62B 7/02* (2013.01); *A45F 3/12* (2013.01); *A62B 17/003* (2013.01); *A62B 35/00* (2013.01); *A62B 35/0025* (2013.01); *G08B 5/004* (2013.01)

(58) Field of Classification Search

CPC ..... A62B 25/00; A62B 35/00; A62B 35/0025; A62B 9/00; A41D 13/01; A45F 3/12; A45F 2003/025; G08B 5/004

See application file for complete search history.

(56) References Cited

U.S. PATENT DOCUMENTS 1,631,694 A * 6/1927 Rick ..... A45F 3/12 2/460
4,575,874 A * 3/1986 Johnson ..... A41F 15/007 2/460
4,741,574 A * 5/1988 Weightman ..... B60R 22/00 280/733
D298,386 S * 11/1988 Hirahara ..... 224/264
4,969,663 A * 11/1990 Nowacki ..... B60R 22/00 280/801.1
5,169,702 A * 12/1992 Schell ..... A01K 27/006 119/858
D338,552 S * 8/1993 Carrico ..... D2/639
5,250,345 A * 10/1993 Chu ..... A45F 3/12 2/268
D354,842 S * 1/1995 Imre ..... D2/891
5,388,743 A * 2/1995 Silagy ..... A45F 3/12 2/268

(Continued)

*Primary Examiner* — Justin M Larson

(57) ABSTRACT

A self-contained breathing apparatus (SCBA) wrap system that is designed to protect and prolong the life of SCBA equipment. The SCBA wrap system includes a plurality of SCBA strap wraps and a SCBA cylinder wrap. Each of the plurality of SCBA strap wraps is configured to protect a particular strap of the SCBA, while the SCBA cylinder wrap protects the SCBA tank. Both the plurality of SCBA strap wraps and the SCBA cylinder wrap are made from fire retardant materials and include a reflective surface to increase the visibility of the user. Furthermore, each of the plurality of SCBA strap wraps and the SCBA cylinder wrap may each include a light assembly to further increase the user's visibility.

16 Claims, 18 Drawing Sheets

(56) References Cited

U.S. PATENT DOCUMENTS 5,463,369 A * 10/1995 Lamping ..... B60R 22/48 280/801.1
5,507,422 A * 4/1996 Shields ..... A45F 3/12 2/268
5,511,846 A * 4/1996 Fuller ..... A45C 3/00 294/149
5,558,556 A * 9/1996 Froehlich ..... A41F 15/007 2/267
5,566,871 A * 10/1996 Weintraub ..... A45F 3/12 2/268
5,984,488 A * 11/1999 Tung ..... A41D 13/01 362/108
D428,554 S * 7/2000 Phelps ..... D3/316
6,170,959 B1 * 1/2001 Richardson, III ..... G08B 5/004 359/516
D459,810 S * 7/2002 Hetzel, Jr. ..... D24/164
6,517,214 B1 * 2/2003 Mitchell, Jr. ..... A41D 13/01 2/94
D486,551 S * 2/2004 McQuiston ..... D23/206
6,752,466 B2 * 6/2004 Liang ..... B60R 22/00 280/808
6,772,711 B2 * 8/2004 Morgan ..... A01K 27/006 119/795
7,316,435 B2 * 1/2008 Leighton ..... A45C 11/00 150/154
7,753,589 B2 * 7/2010 Palt ..... F17C 13/084 150/154
7,874,691 B2 * 1/2011 Kormos ..... A62B 33/00 362/101
8,128,269 B2 * 3/2012 Boyadjieff ..... G08B 5/002 340/306
8,662,682 B2 * 3/2014 Gorodisher ..... G08B 5/004 359/519
8,840,263 B1 * 9/2014 Jones ..... A41D 13/01 362/108
9,259,067 B2 * 2/2016 Kruse ..... A45C 3/00
9,610,866 B2 * 4/2017 Mitsuo ..... B60N 2/2812
9,705,262 B2 * 7/2017 Allen ..... H01R 13/717
10,074,295 B2 * 9/2018 Hyman ..... A42B 3/0453
2004/0070256 A1 * 4/2004 Lee ..... B60R 22/00 297/482
2007/0007314 A1 * 1/2007 Lin ..... A45F 3/12 224/264
2008/0006661 A1 * 1/2008 Godshaw ..... A45C 13/30 224/264
2010/0052875 A1 * 3/2010 Boyadjieff ..... G08B 5/002 340/332
2010/0288274 A1 * 11/2010 Hudson ..... B63C 11/22 128/202.13
2011/0156469 A1 * 6/2011 Carpenter ..... B60R 22/105 297/482
2013/0320054 A1 * 12/2013 Kruse ..... A45C 3/00 224/235
2014/0237799 A1 * 8/2014 Green ..... G09F 3/08 29/428
2017/0043191 A1 * 2/2017 Sangirardi ..... A62B 9/04
2017/0196347 A1 * 7/2017 Sawhney ..... A45F 3/12
2017/0290407 A1 * 10/2017 Wilke ..... A45F 3/005
2017/0309206 A1 * 10/2017 Hyman ..... A42B 3/0453
2018/0064969 A1 * 3/2018 Lopez ..... A62B 35/0025
2018/0132555 A1 * 5/2018 Gonzalez ..... A45F 5/021
2018/0193679 A1 * 7/2018 Holman ..... A62B 25/00
2018/0263363 A1 * 9/2018 Ward ..... A45F 3/02
2019/0030378 A1 * 1/2019 Zhu ..... A62B 9/04

* cited by examiner

SELF-CONTAINED BREATHING APPARATUS WRAP SYSTEM

The current application claims a priority to the U.S. Provisional Patent application Ser. No. 62/445,535 filed on Jan. 12, 2017.

FIELD OF THE INVENTION

The present invention relates generally to fire safety equipment. More specifically, the present invention is a wrap system that is used to protect and prolong the life of self-contained breathing apparatus equipment, offering extra protection from extreme heat, water exposure above and below freezing temperatures, chemical exposure, smoke exposure and the contaminants therein, and ultraviolet light exposure.

BACKGROUND OF THE INVENTION

Self-contained breathing apparatus (SCBA) straps are made with a flame-resistant meta-aramid material, which takes a tremendous amount of abuse throughout the life of the SCBA. The SCBA straps are exposed to extreme heat, water exposure above and below freezing temperatures, chemicals, smoke and the contaminants therein, and of course ultraviolet light. Over time the flame-resistant meta-aramid fabric deteriorates from all of the use and abuse, and the result is a fabric that was once inherently fire retardant, has now become vulnerable. The fabric rips & tears easily, fades in color, and loses its ability to withstand the extreme heat of even fire, which it was designed for. This of course a danger to the user when using the SCBA equipment in extreme and dangerous conditions. Depending on the specific straps and pads, replacement parts for a SCBA system can cost upwards of $600. A further issue with the current SCBA equipment is that it does nothing to visually accent the user.

Therefore it is an object of the present invention to provide a SCBA wrap system that can be easily and inexpensively replaced rather than spending hundreds of dollars for a new parts of the SCBA. Furthermore, it is an object of the present invention to offer extra protection to the SCBA equipment from the previously mentioned harmful forces. It is yet a further objective of the present invention to increase the visibility of the user, by allowing for the user to be seen with reflecting and lighting components. The present invention includes a plurality of SCBA strap wraps and a SCBA cylinder wrap. Each of the plurality of SCBA strap wraps is configured to protect a particular strap of the SCBA, while the SCBA cylinder wrap protects the SCBA tank. Both the plurality of SCBA strap wraps and the SCBA cylinder wrap are made from fire retardant materials and include a reflective surface to increase the visibility of the user. Furthermore, each of the plurality of SCBA strap wraps and the SCBA cylinder wrap may each include a light assembly to further increase the user's visibility.

DETAIL DESCRIPTIONS OF THE INVENTION

All illustrations of the drawings are for the purpose of describing selected versions of the present invention and are not intended to limit the scope of the present invention.

The present invention is a self-contained breathing apparatus (SCBA) wrap system that is designed to protect and prolong the life of SCBA equipment. The present invention protects SCBA equipment from extreme heat, water exposure above and below freezing temperatures, chemical exposure, smoke exposure and the contaminants therein, and ultraviolet light exposure. The present invention can be used with both new and old SCBA equipment, and is designed to fit over any make and model of SCBA equipment. Components of the present invention can be easily and individually replaced, and replaced cheaper than compared to the SCBA equipment, when the components show signs of heavy use and deterioration.

Figure 17:
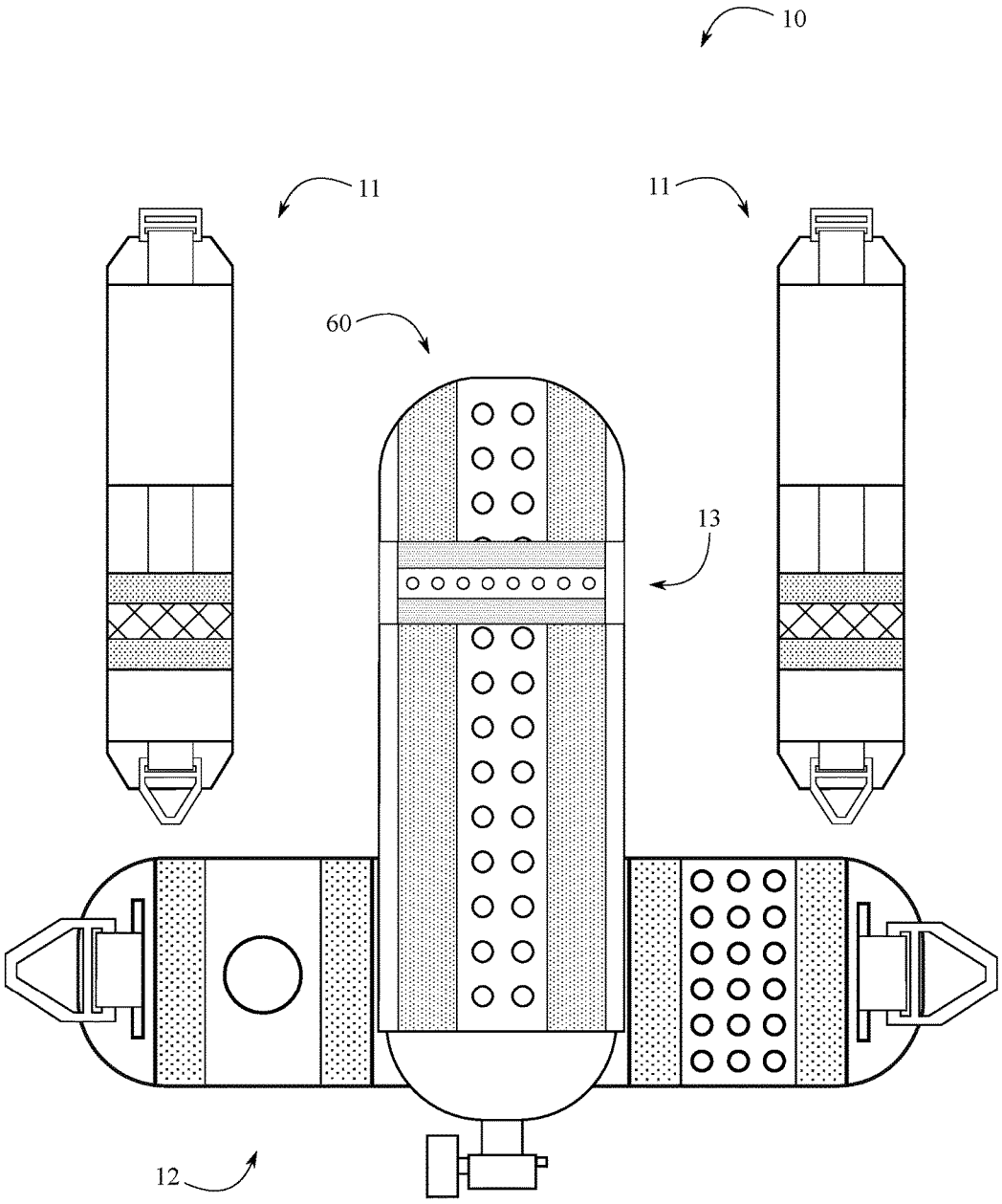
FIG. 17 is a diagram showing the plurality of SCBA strap wraps and the SCBA cylinder wrap.

In reference to FIG. 17, the present invention comprises a SCBA cylinder wrap 60 and a plurality of SCBA strap wraps 10, wherein each of the plurality of SCBA strap wraps 10 is a wrap selected from the group consisting of a shoulder wrap 11, a lumbar wrap 12, and a cylinder retention wrap 13. In the full implementation of the present invention, the plurality of SCBA strap wraps 10 comprises two shoulder wraps, one lumbar wrap, and one cylinder retention wrap. In this way, the present invention protects each of the existing straps of the SCBA through the plurality of SCBA strap wraps 10 and the tank of the SCBA through the SCBA cylinder wrap 60.

Figure 1:
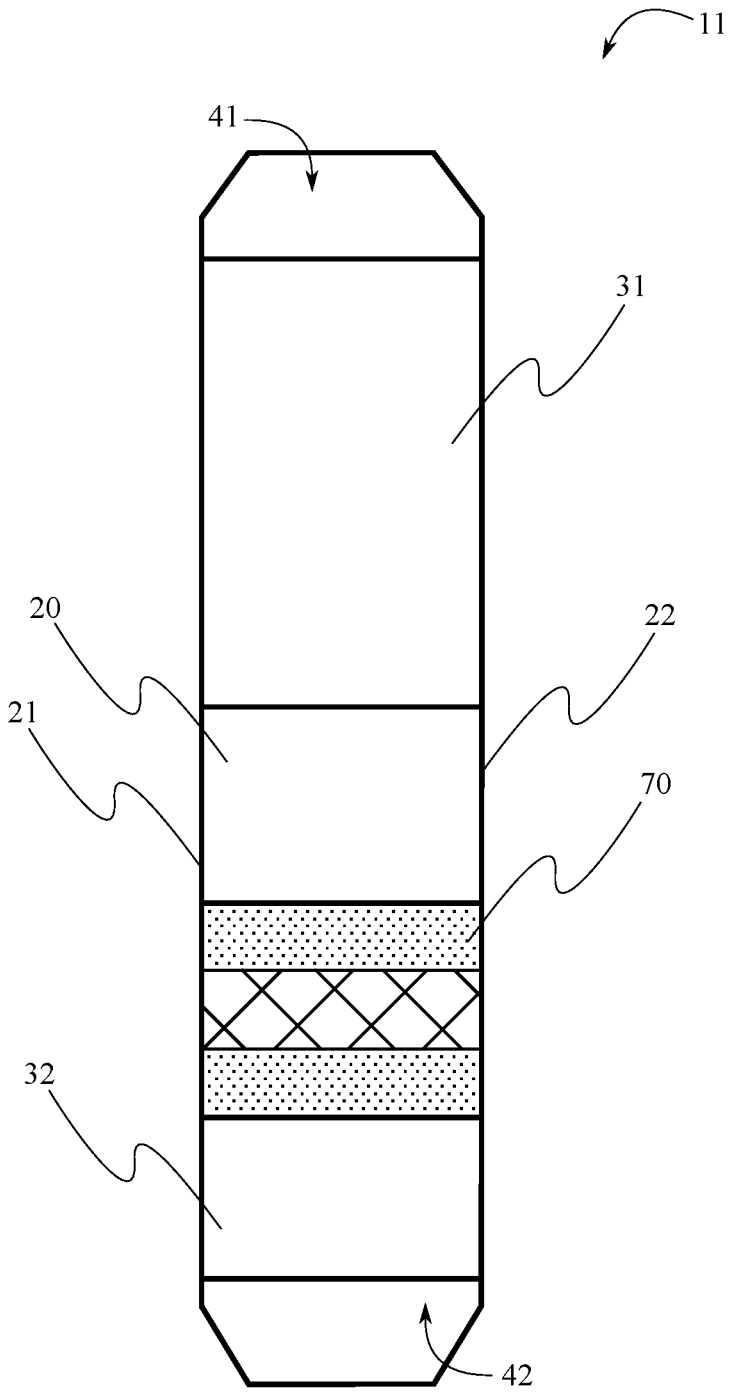
FIG. 1 is a front elevational view of the shoulder wrap.
Figure 2:
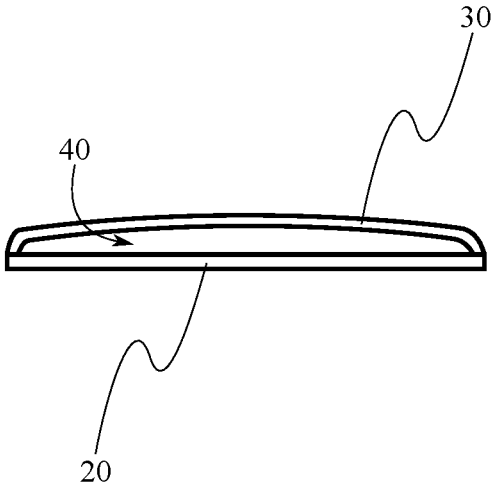
FIG. 2 is a bottom plan view of the one of the plurality of SCBA strap wraps, showing the strap receiving channel.
Figure 3:
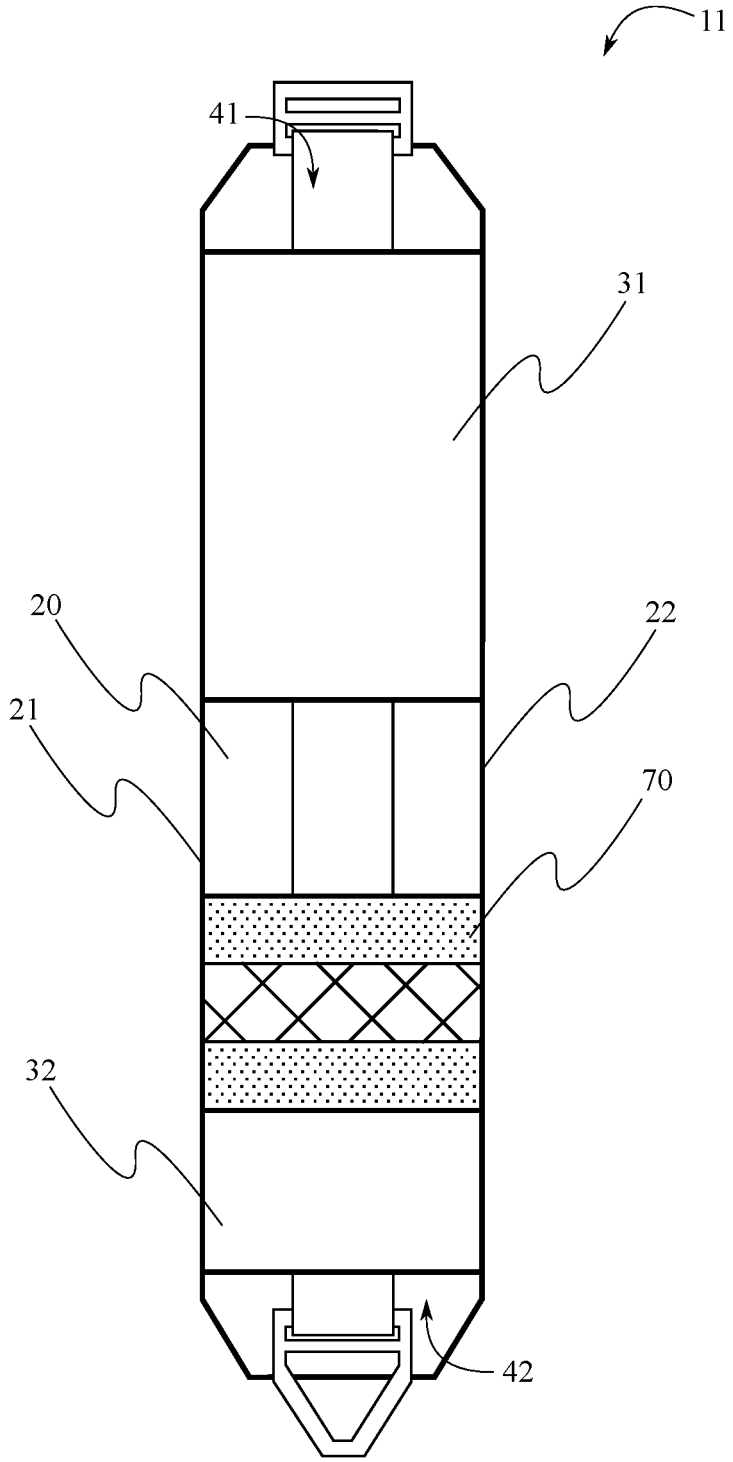
FIG. 3 is a front elevational view of the shoulder wrap, wherein a strap is positioned through the strap receiving channel.

In reference to FIG. 1, each of the plurality of SCBA strap wraps 10 comprises a backing 20, a front encasement 30, and a reflective surface 70. The front encasement 30 is adjacently connected to the backing 20 along a first longitudinal edge 21 and second longitudinal edge 22 of the backing 20, wherein the front encasement 30 and the backing 20 form a strap receiving channel 40, depicted in FIG. 2, into which a SCBA strap is positioned. The strap receiving channel 40 has a first opening 41 and a second opening 42 positioned opposite each other along the first longitudinal edge 21 and the second longitudinal edge 22, allowing the ends of the SCBA strap to protrude from the strap receiving channel 40, as depicted in FIG. 3. Depending on the embodiment of the present invention, each of the plurality of SCBA strap wraps 10 may be configured to either slip over an existing SCBA strap, or be secured around the existing SCBA strap via a fastener system.

Figure 4:
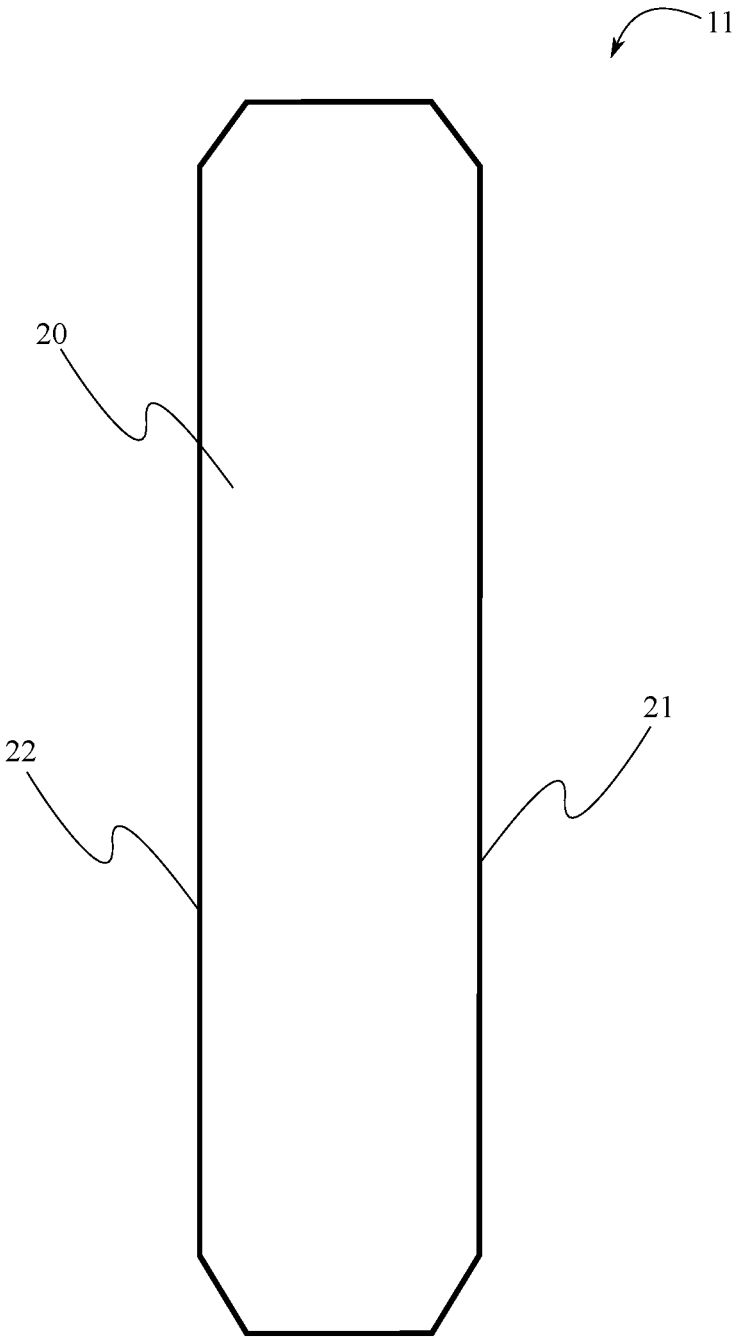
FIG. 4 is a rear elevational view of the shoulder wrap, wherein the shoulder wrap is configured to slip over a strap.
Figure 5:
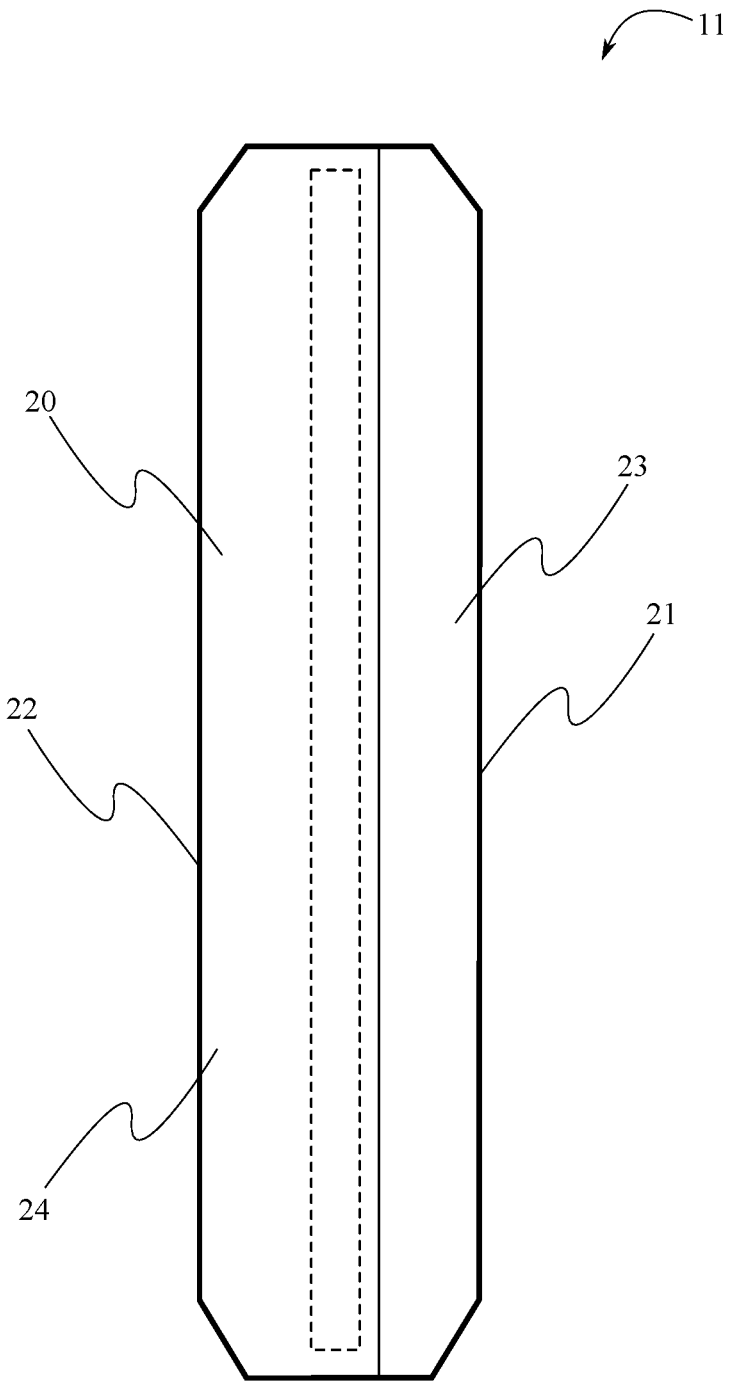
FIG. 5 is a rear elevational view of the shoulder wrap, wherein the shoulder wrap is configured to be fastened around a strap.
Figure 12:
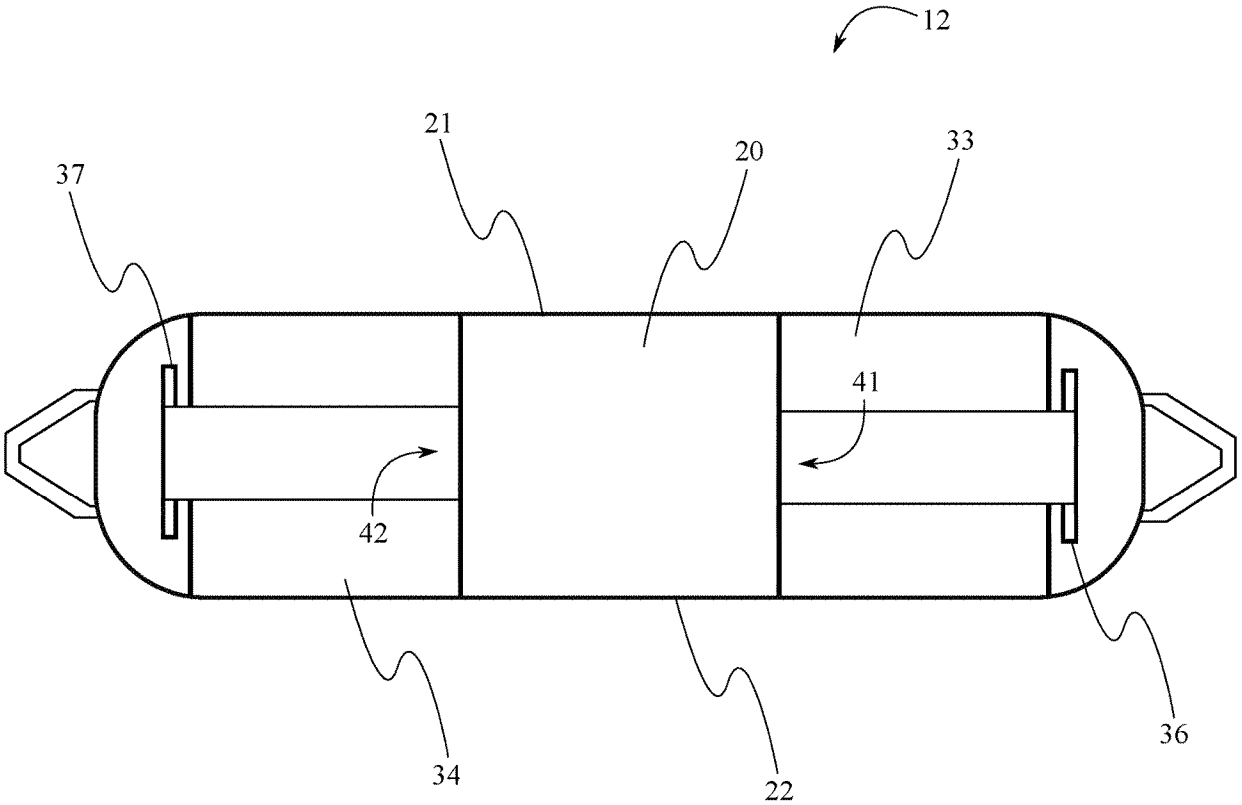
FIG. 12 is a rear elevational view of the lumbar wrap, wherein the lumbar wrap is configured to sip over a strap.
Figure 13:
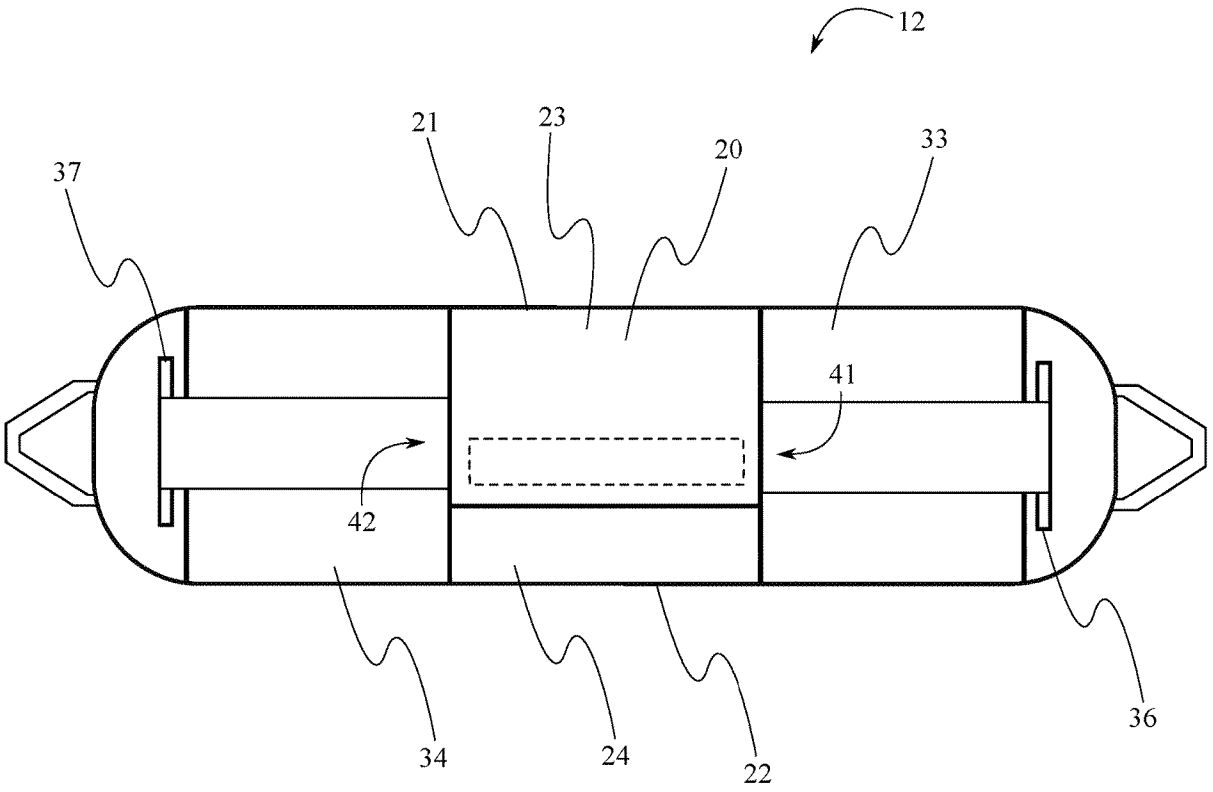
FIG. 13 is a rear elevational view of the lumbar wrap, wherein the lumbar wrap is configured to be fastened around a strap.

In embodiments where each of the plurality of SCBA strap wraps 10 is configured to slip over an existing SCBA strap, the backing 20 is a single piece of material, as depicted in FIG. 4 and FIG. 12. The SCBA strap is simply slid into the first opening 41 or the second opening 42 and slid through the strap receiving channel 40 in order to secure the wrap to the SCBA strap. In embodiments where each of the plurality of SCBA strap wraps 10 is configured to be secured around an existing SCBA strap, the backing 20 of each of the plurality of SCBA strap wraps 10 comprises a first flap 23 and a second flap 24, as depicted in FIG. 5 and FIG. 13. The first longitudinal edge 21 is positioned along the first flap 23, while the second longitudinal edge 22 is positioned along the second flap 24, wherein the first flap 23 and the second flap 24 are connected to opposite sides of the front encasement 30.

The first flap 23 and the second flap 24 are selectively engaged with each other, such that the backing 20 can be opened and closed. The second flap 24 is disengaged from the first flap 23 in order to open the backing 20 and allow the SCBA strap to be positioned into or removed from the strap receiving channel 40. To secure the wrap around the SCBA strap, the second flap 24 is engaged with the first flap 23 in order to close the backing 20. A first fastener is integrated along the first flap 23 opposite the first longitudinal edge 21, while a second fastener is integrated along the second flap 24 opposite the second longitudinal edge 22. Preferably, the first fastener and the second fastener are opposing hook and loop fastening strips. However, the first fastener and the second fastener may be other interconnecting bodies such as snaps, buttons, buckles, etc.

In reference to FIG. 1, the reflective surface 70 is disposed on the front encasement 30 opposite the backing 20, such that the reflective surface 70 faces outwards, away from the user when the plurality of SCBA strap wraps 10 is worn. The reflective surface 70 acts to reflect light that is directed at the user in order to make the location of the user more apparent; particularly in low visibility environments. Preferably, the reflective surface 70 is a reflective tape that is adhered to the front encasement 30. However, it is possible for the reflective surface 70 to be connected to the front encasement 30 using a different fastening means, or integrated into the front encasement 30 at the time of manufacture. The reflective surface 70 can be configured in a variety of different colors.

Figure 6:
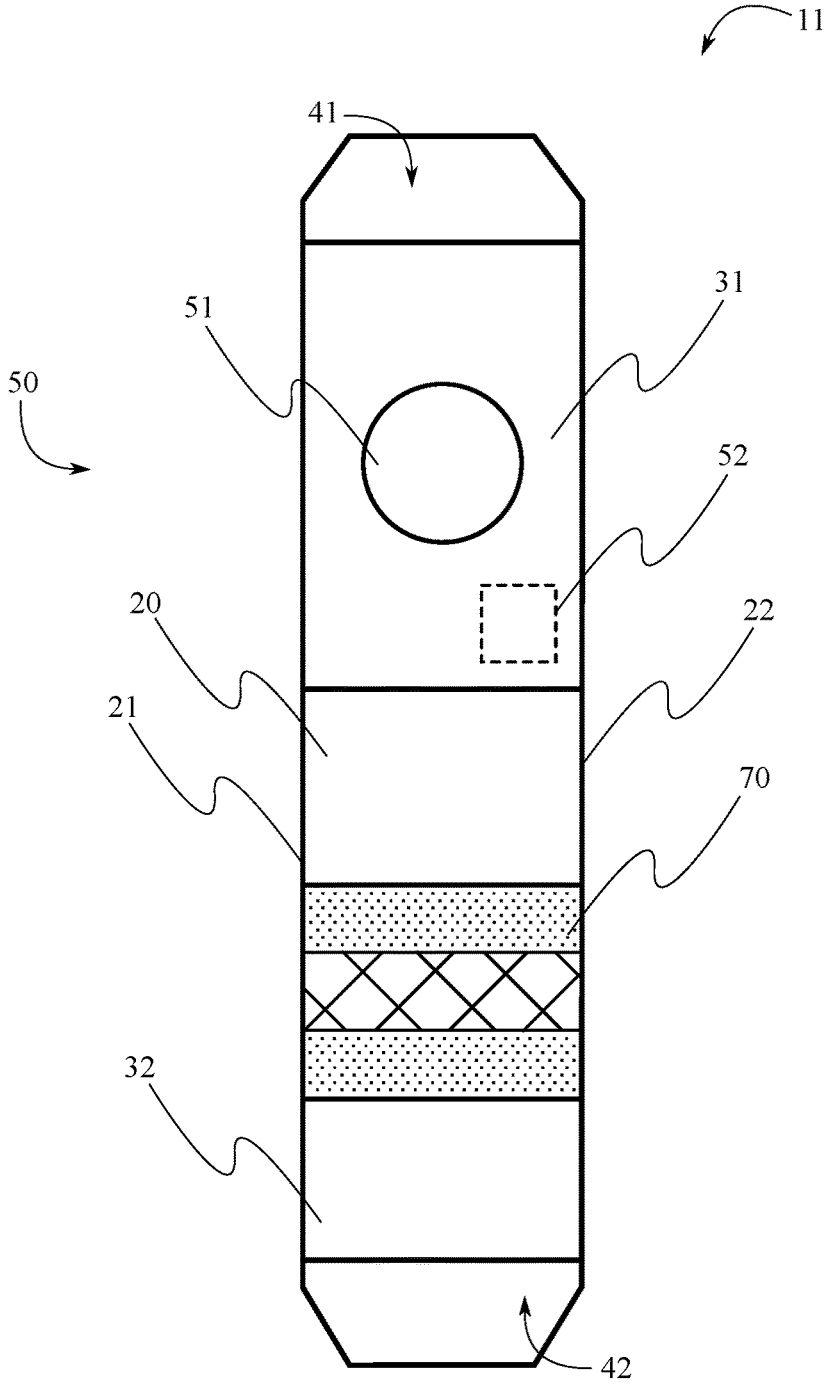
FIG. 6 is front elevational view of the shoulder wrap, wherein the light source being a single LED is integrated into the first section.
Figure 7:
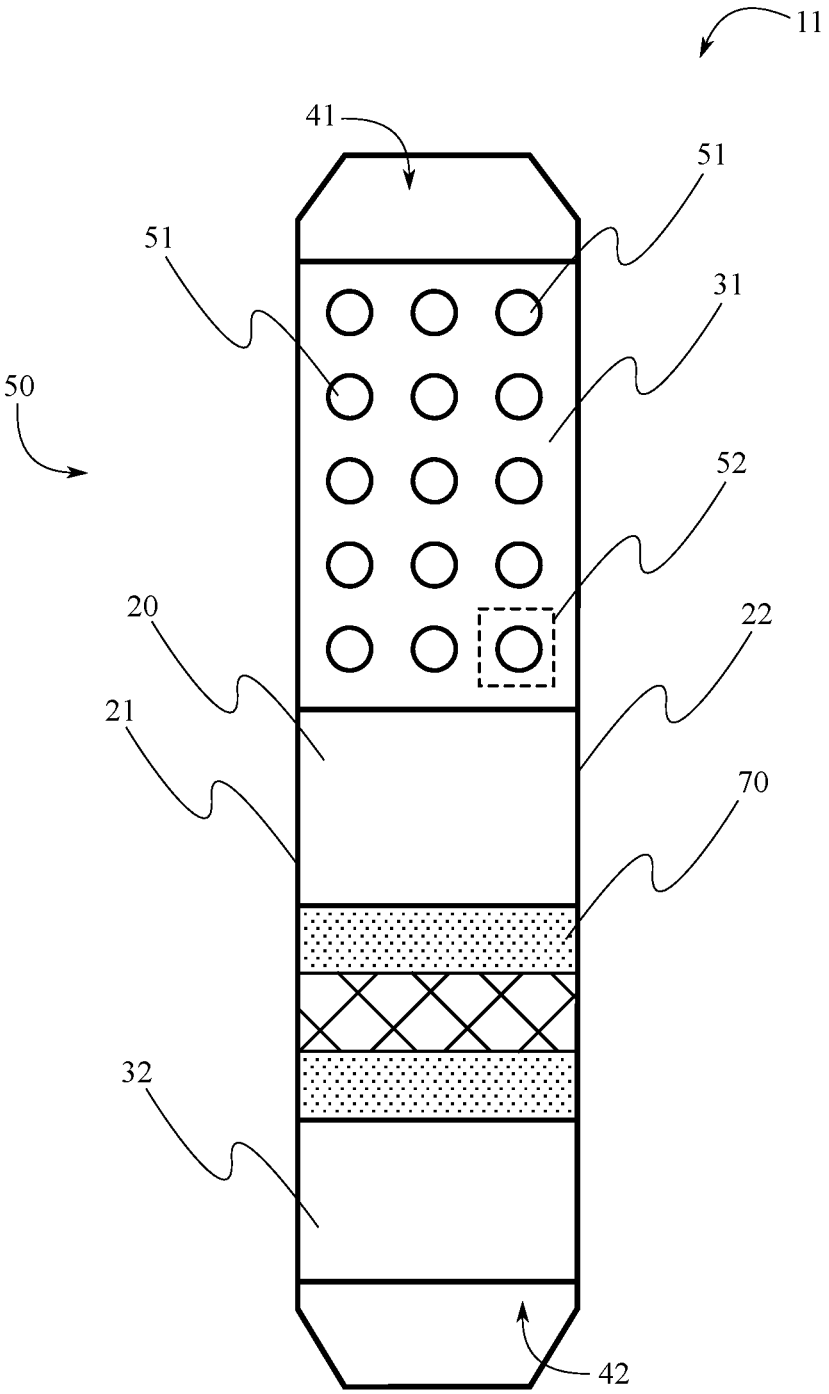
FIG. 7 is a front elevational view of the shoulder wrap, wherein the light source being multiple LEDs is integrated into the first section.
Figure 18:
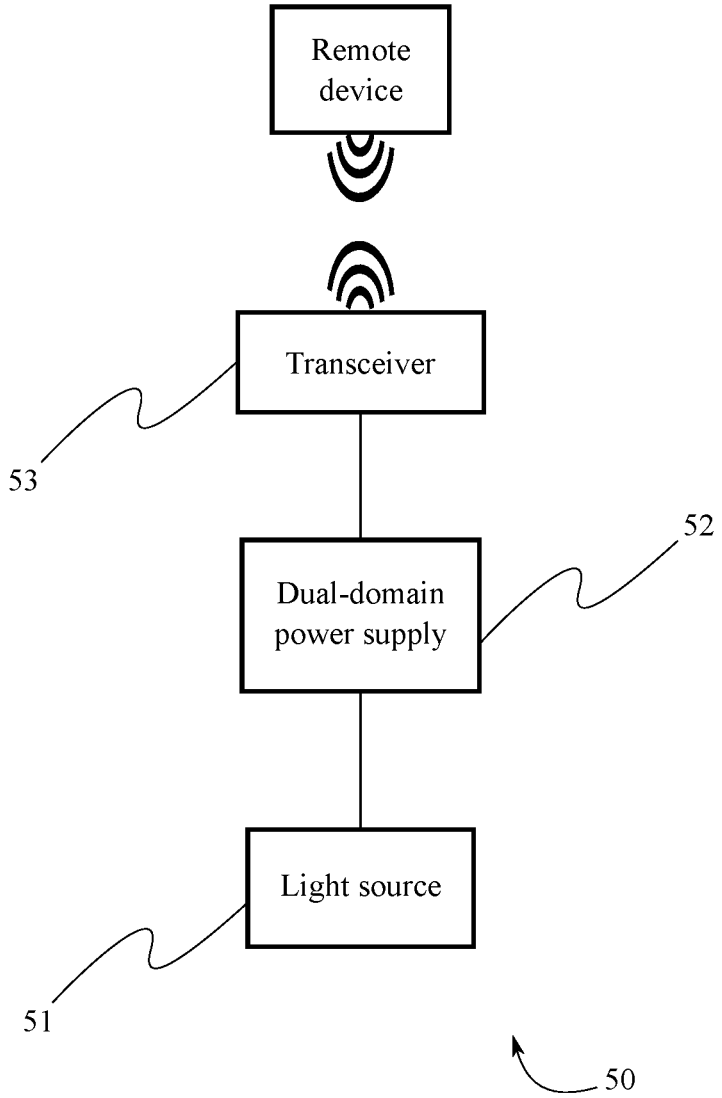
FIG. 18 is an electrical diagram showing the electrical connections of the light assembly.

In some embodiments of the present invention, each of the plurality of SCBA strap wraps 10 further comprises a light assembly 50. In reference to FIG. 6-7, the light assembly 50 is integrated into the front encasement 30 and provides an additional means of increasing the visibility of the user. The light assembly 50 comprises a light source 51 and a dual-domain power supply 52. The light source 51 is integrated into the front encasement 30 opposite the backing 20, such that the light source 51 faces outwards, away from the user when the plurality of SCBA straps is worn. The light source 51 is electrically connected to the dual-domain power supply 52 as depicted in FIG. 18, wherein the dual-domain power supply 52 directs current from one of two power sources to the light source 51. In one embodiment, the light source 51 is a single light emitting diode (LED), as depicted in FIG. 6, while in another embodiment, the light source 51 is a plurality of LEDs, as depicted in FIG. 7. However, the light source 51 is not limited to the use of LEDs and may be any other source of electrically produced illumination.

The dual-domain power supply 52 allows current to be derived from one of two sources: a battery pack or the extant SCBA power supply. The dual-domain power supply 52 is internally integrated into the front encasement 30, in addition to the battery pack. The battery pack may be either a replaceable battery pack or a rechargeable battery pack. In embodiments where the battery pack is a rechargeable battery pack, a charging port is integrated into the front encasement 30, wherein the charge port is accessible from the strap receiving channel 40 (i.e. between the front encasement 30 and the backing 20). The dual-domain power supply 52 may be configured to manually switch between the power sources through the use of a switch integrated into the front encasement 30, or automatically switch between the power sources through the use of an intelligent switching circuit. The intelligent switching circuit selects an alternative power source, if the main power source is absent or drops below a critical voltage level. Preferably, the power source switching of the intelligent switching circuit is performed with advanced metal-oxide-semiconductor field-effect transistors (MOSFETs), to ensure very low power loss.

In some embodiments, the light source 51 may be normally in a powered off state, wherein the light source 51 is powered on via an encrypted radio frequency link. In such embodiments, the light assembly 50 further comprises a transceiver 53 that is electrically connected to the dual-domain power supply 52, as depicted in FIG. 18. In one configuration, an activation signal is transmitted from a remote device using the encrypted radio frequency link. Upon receiving the activation signal through the transceiver 53, the dual-domain power supply 52 is instructed to supply current to the light source 51. In another configuration, the transceiver 53 and the remote device continuously maintain the encrypted radio frequency link, wherein the dual-domain power supply 52 is programmed to supply current to the light source 51 if the encrypted radio frequency link is interrupted or lost for a defined period of time.

Each of the plurality of SCBA strap wraps 10 is uniquely configured to engage with a specific SCBA strap. More specifically, the shoulder wrap 11 is configured to protect a SCBA shoulder strap, the lumbar wrap 12 is configured to protect a SCBA lumbar strap, and the cylinder retention wrap 13 is configured to protect a SCBA retention strap. Each of the shoulder wrap 11, the lumbar wrap 12, and the cylinder retention wrap 13 are constructed from a fire-retardant material, such as a flame-resistant meta-aramid material, to protect the existing SCBA straps from exposure to extreme heat. The material of each of the plurality of SCBA strap wraps 10 may be a variety of colors, some of which may be intended to help bring greater visual awareness to the user.

In reference to FIG. 3, the shoulder wrap 11 is designed to allow for the attachment of a regulator onto the existing SCBA shoulder strap. As such, the front encasement 30 of the shoulder strap comprises a first section 31 and a second section 32, wherein the first section 31 and the second section 32 are offset from each other. The offset nature of the first section 31 and the second section 32 provides an opening in which a portion of the SCBA shoulder strap is not covered by the front encasement 30 of the shoulder wrap 11. This allows the regulator to be attached to the uncovered portion of the SCBA shoulder strap, while the remainder of the SCBA shoulder strap is protected beneath the first section 31 and the second section 32. The buckles and ends of the SCBA shoulder strap extend out of the first opening 41 and the second opening 42 of the shoulder wrap 11 in order to engage with the SCBA frame or the SCBA lumbar strap.

The reflective surface 70 of the shoulder wrap 11 may be disposed on one or both of the first section 31 and the second section 32. In reference to FIG. 6-7, in embodiments using the light assembly 50, the light assembly 50 of the shoulder wrap 11 is integrated into the first section 31, while the reflective surface 70 of the shoulder wrap 11 is integrated into the second section 32. Preferably, the first section 31 is positioned above the opening for the regulator, while the second section 32 is positioned below the opening for the regulator; however, the position of the first section 31 and the second section 32 may be flipped. When worn by the user, the backing 20 of the shoulder wrap 11 is positioned against the anterior of the user's torso, while the front encasement 30 of the shoulder wrap 11 is disposed away from the user's torso. In this way, the reflective surface 70 and the light source 51 of the shoulder wrap 11 are directed outwards, away from the user in order to provide others with greater visual awareness of the user.

In reference to FIG. 1, the backing 20 of the shoulder wrap 11 extends past the front encasement 30 of the shoulder wrap 11. In embodiments where the backing 20 of the shoulder wrap 11 utilizes the fastener system to be secured to the SCBA shoulder strap, the first flap 23 of the shoulder wrap 11 is positioned to either the medial or lateral side of the SCBA shoulder strap, while the second flap 24 of the shoulder wrap 11 is positioned opposite of the first flap 23 of the shoulder wrap 11. The first flap 23 and the second flap 24 of the shoulder wrap 11 allow the entire length of the backing 20 of the shoulder wrap 11 to be opened in order to insert or remove the SCBA shoulder strap.

Figure 8:
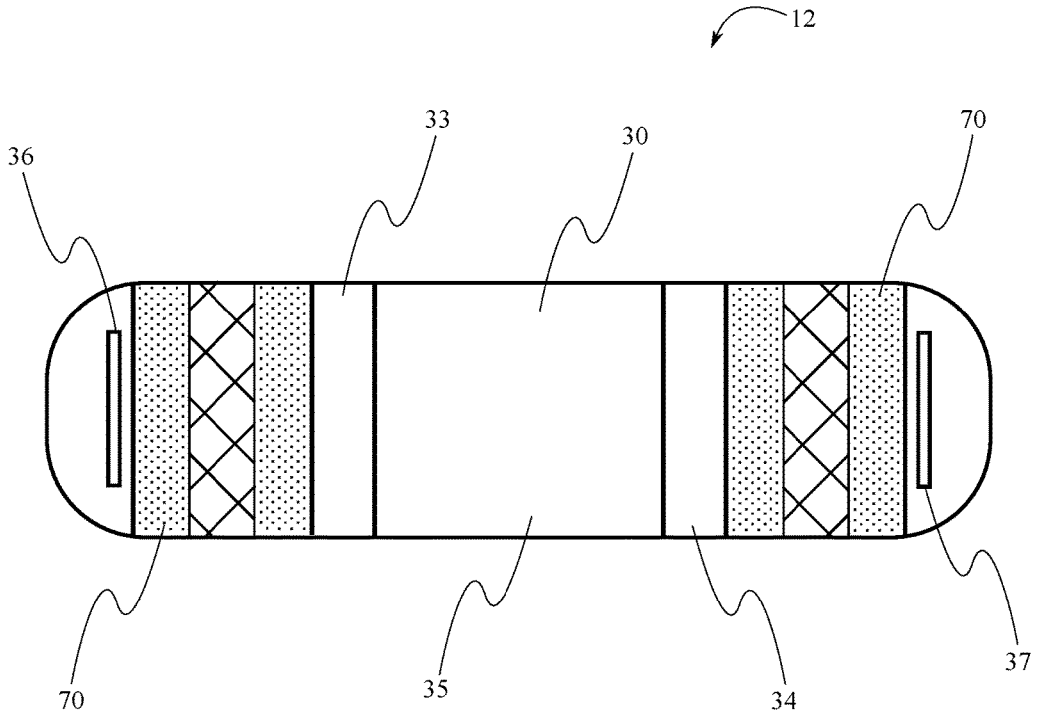
FIG. 8 is a front elevational view of the lumbar wrap.
Figure 9:
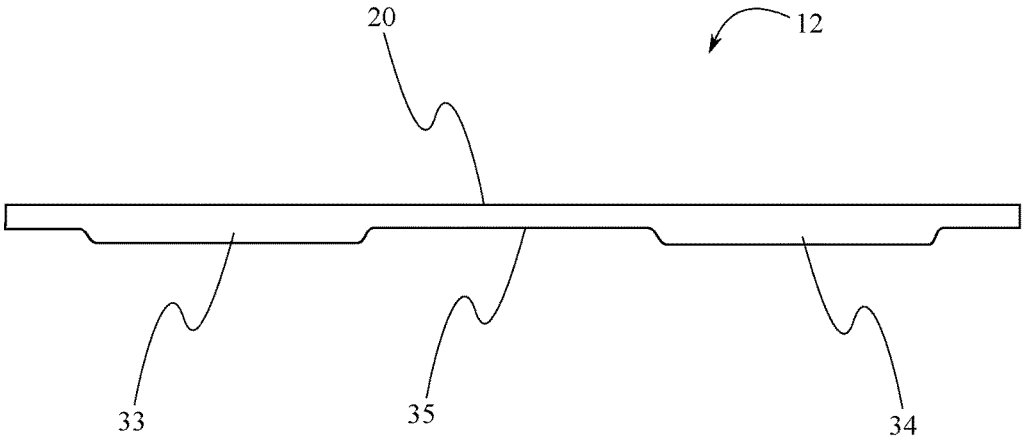
FIG. 9 is a top plan view of the lumbar wrap, showing the SCBA frame indentation.

The lumbar wrap 12 is designed to allow for the over the top placement of the SCBA frame. As such, front encasement 30 of the lumbar wrap 12 comprises a first reinforced section 33, a second reinforced section 34, and a SCBA frame indentation 35. In reference to FIG. 8-9, the SCBA frame indentation 35 is positioned in between the first reinforced section 33 and the second reinforced section 34, wherein the SCBA frame indentation 35 is centrally positioned along the lumbar wrap 12. The central position of the SCBA frame indentation 35 allows the SCBA frame to sit over top of the lumbar wrap 12, while the first reinforced section 33 and the second reinforced section 34 provide added protection over the ends of the SCBA lumbar strap.

The backing 20 of the lumbar wrap 12 is shorter than the front encasement 30 of the lumbar wrap 12, as depicted in FIG. 12-13, wherein the backing 20 of the lumbar wrap 12 is aligned with the SCBA frame indentation 35 and approximately the same size as the SCBA frame indentation 35. In this way, the first reinforced section 33 and the second reinforced section 34 extends out past the backing 20 of the lumbar wrap 12. In embodiments where the backing 20 of the lumbar wrap 12 utilizes the fastener system to be secured to the SCBA lumbar strap, the first flap 23 of the lumbar wrap 12 is positioned to either the superior or inferior side of the SCBA lumbar strap, while the second flap 24 of the lumbar wrap 12 is positioned opposite of the first flap 23 of the lumbar wrap 12. The first flap 23 and the second flap 24 of the lumbar wrap 12 allow the entire length of the backing 20 of the lumbar wrap 12 to be opened in order to insert or remove the SCBA lumbar strap.

Figure 10:
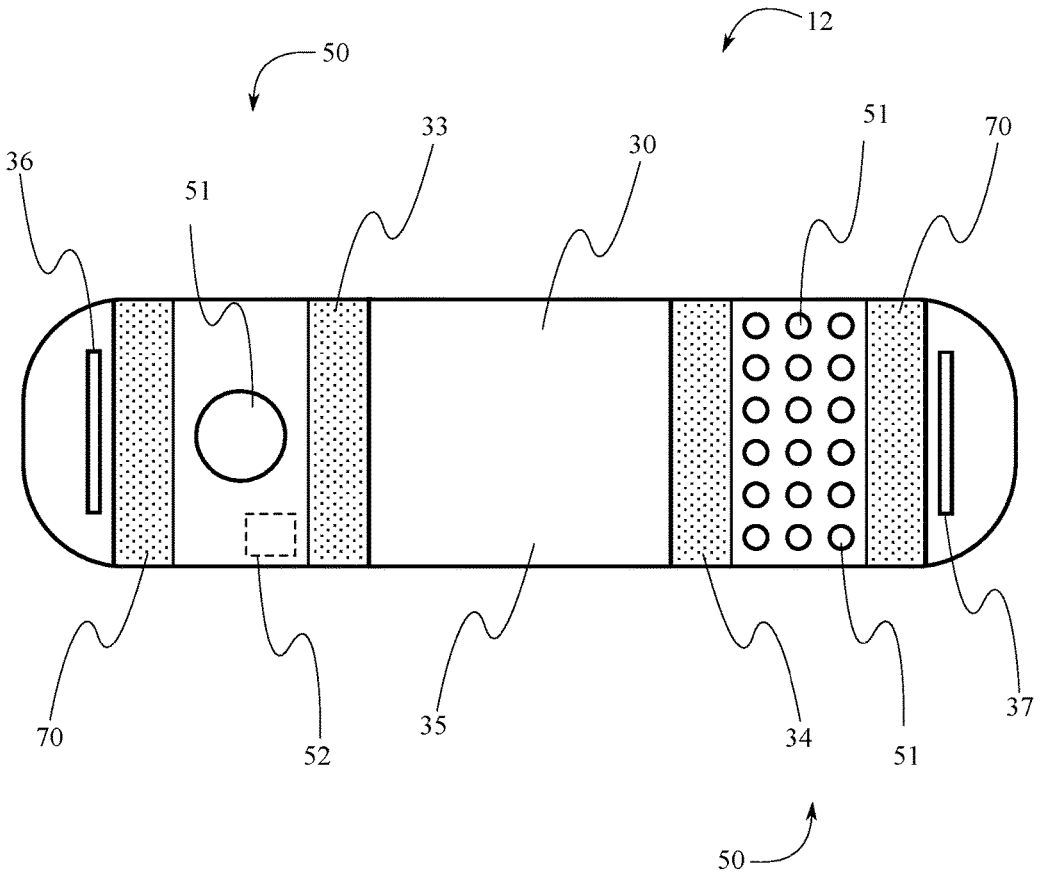
FIG. 10 is a front elevational view of the lumbar wrap, wherein the light assembly is integrated into the first reinforced section and the second reinforced section.
Figure 11:
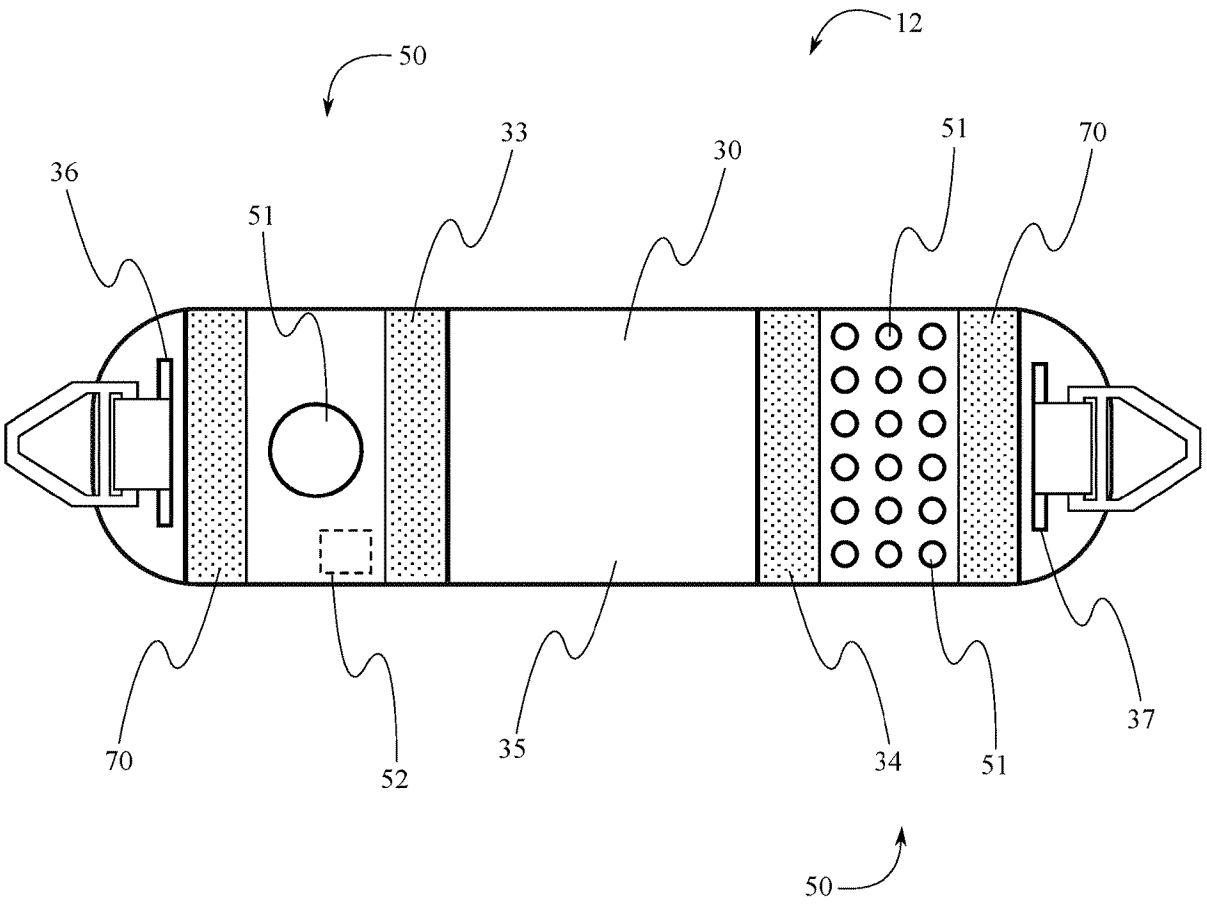
FIG. 11 is front elevational view of the lumbar wrap, wherein a strap is positioned through the strap receiving channel.

In reference to FIG. 10-11, the front encasement 30 of the lumbar strap further comprises a first buckle slot 36 and a second buckle slot 37, wherein the first buckle slot 36 and the second buckle slot 37 are terminally positioned opposite each other. The first buckle slot 36 is positioned adjacent to the first reinforced section 33, opposite the SCBA frame indentation 35. Meanwhile, the second buckle slot 37 is positioned adjacent to the second reinforced section 34, opposite the SCBA frame indentation 35. The first buckle slot 36 and the second buckle slot 37 allow the ends of the SCBA lumbar strap to extend out of the lumbar wrap 12, such that the ends of the SCBA lumbar strap can be connected together in order to secure the SCBA lumbar strap around the user.

The reflective surface 70 of the lumbar wrap 12 may be disposed on one or both of the first reinforced section 33 and the second reinforced section 34. In embodiments using the light assembly 50, the light assembly 50 of the lumbar wrap 12 may also be integrated into one or both of the first reinforced section 33 and the second reinforced section 34, as depicted in FIG. 10. When worn by the user, the backing 20 of the lumbar wrap 12 is positioned against the user's lower back and sides, while the front encasement 30 of the lumbar wrap 12 is disposed away from the user's lower back and sides. In this way, the reflective surface 70 and the light source 51 of the lumbar wrap 12 are directed outwards, away from the user in order to provide others with greater visual awareness of the user.

Figure 14:
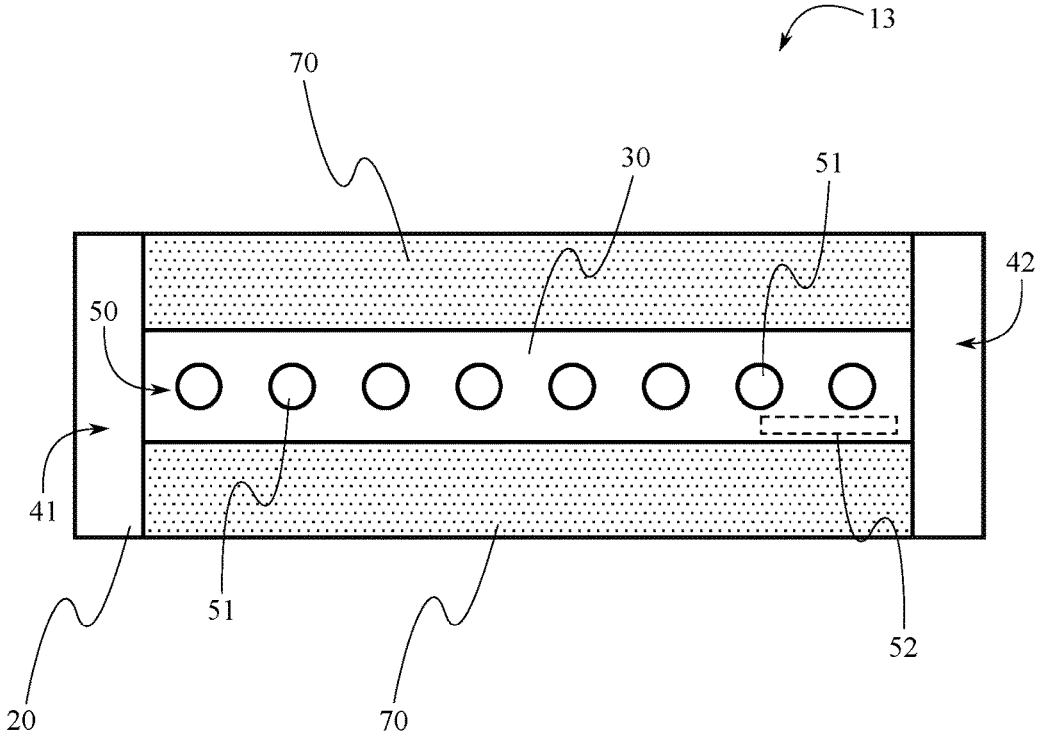
FIG. 14 is a front elevational view of the cylinder retention wrap.

In reference to FIG. 14 and FIG. 17, the cylinder retention wrap 13 is designed to encase the SCBA cylinder retention strap that secures the SCBA tank to the SCBA frame. The backing 20 of the cylinder retention wrap 13 extends past the front encasement 30 of the cylinder retention wrap 13. In embodiments where the backing 20 of the cylinder retention wrap 13 utilizes the fastener system to be secured to the SCBA cylinder retention strap, the first flap 23 of the cylinder retention wrap 13 is positioned to either the superior or inferior side of the SCBA cylinder retention strap, while the second flap 24 of the cylinder retention wrap 13 is positioned opposite of the first flap 23 of the cylinder retention wrap 13. The first flap 23 and the second flap 24 of the cylinder retention wrap 13 allow the entire length of the backing 20 of the cylinder retention wrap 13 to be opened in order to insert or remove the SCBA cylinder retention strap.

The reflective surface 70 of the cylinder retention wrap 13 is disposed along the front encasement 30 of the cylinder retention wrap 13. In embodiments using the light assembly 50, the light assembly 50 of the cylinder retention wrap 13 is integrated into the front encasement 30 of the cylinder retention wrap 13. The light assembly 50 of the cylinder retention wrap 13 may be positioned adjacent to the reflective surface 70 of the cylinder retention wrap 13, in between sections of the reflective surface 70 of the cylinder retention wrap 13, etc. When worn by the user, the backing 20 of the cylinder retention wrap 13 is positioned against the SCBA tank, while the front encasement 30 of the cylinder retention wrap 13 is disposed away from the SCBA tank. In this way, the reflective surface 70 and the light source 51 of the shoulder wrap 11 are directed outwards, away from the SCBA tank in order to provide others with greater visual awareness of the user.

Figure 15:
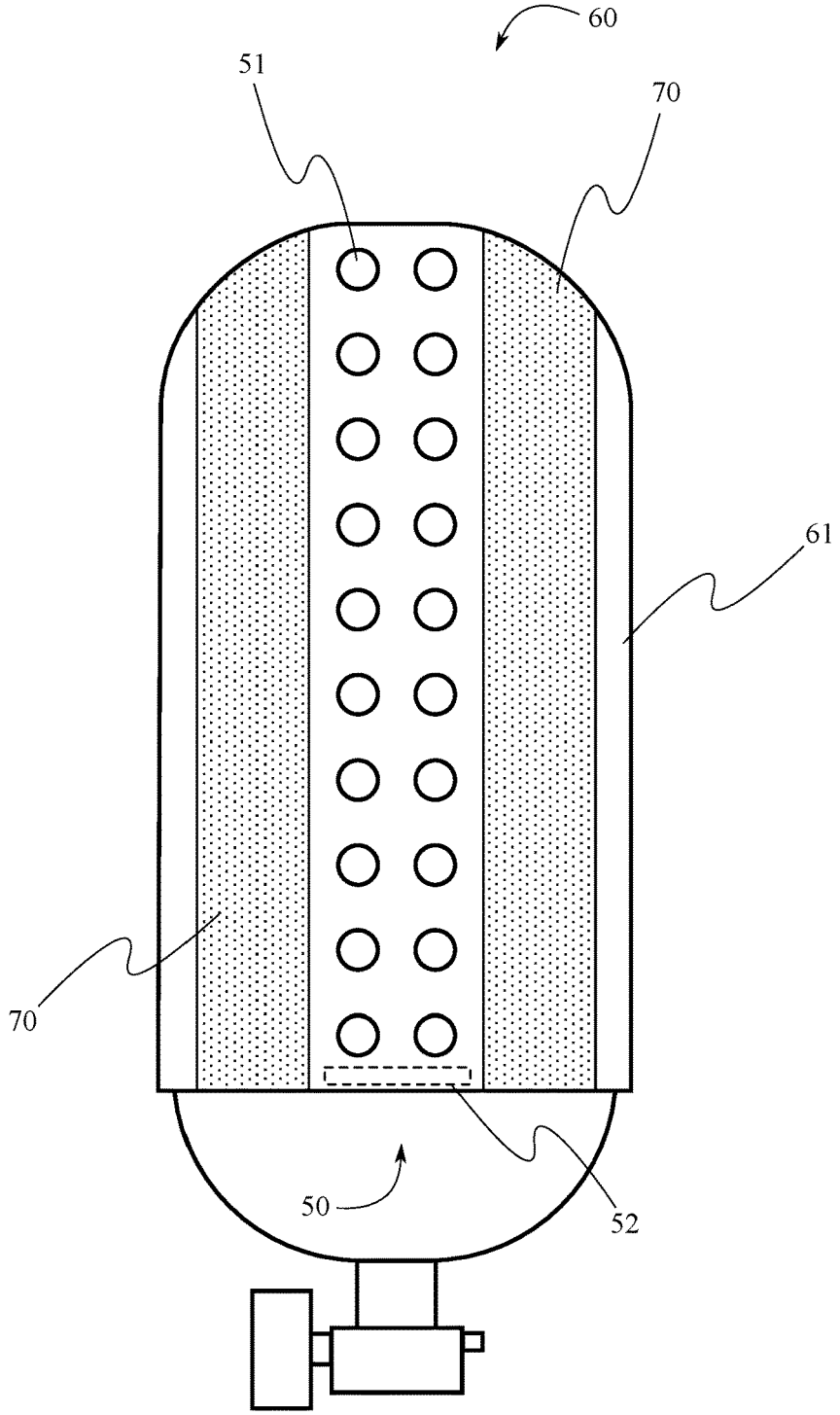
FIG. 15 is a front elevational view of the SCBA cylinder wrap positioned around a SCBA tank.
Figure 16:
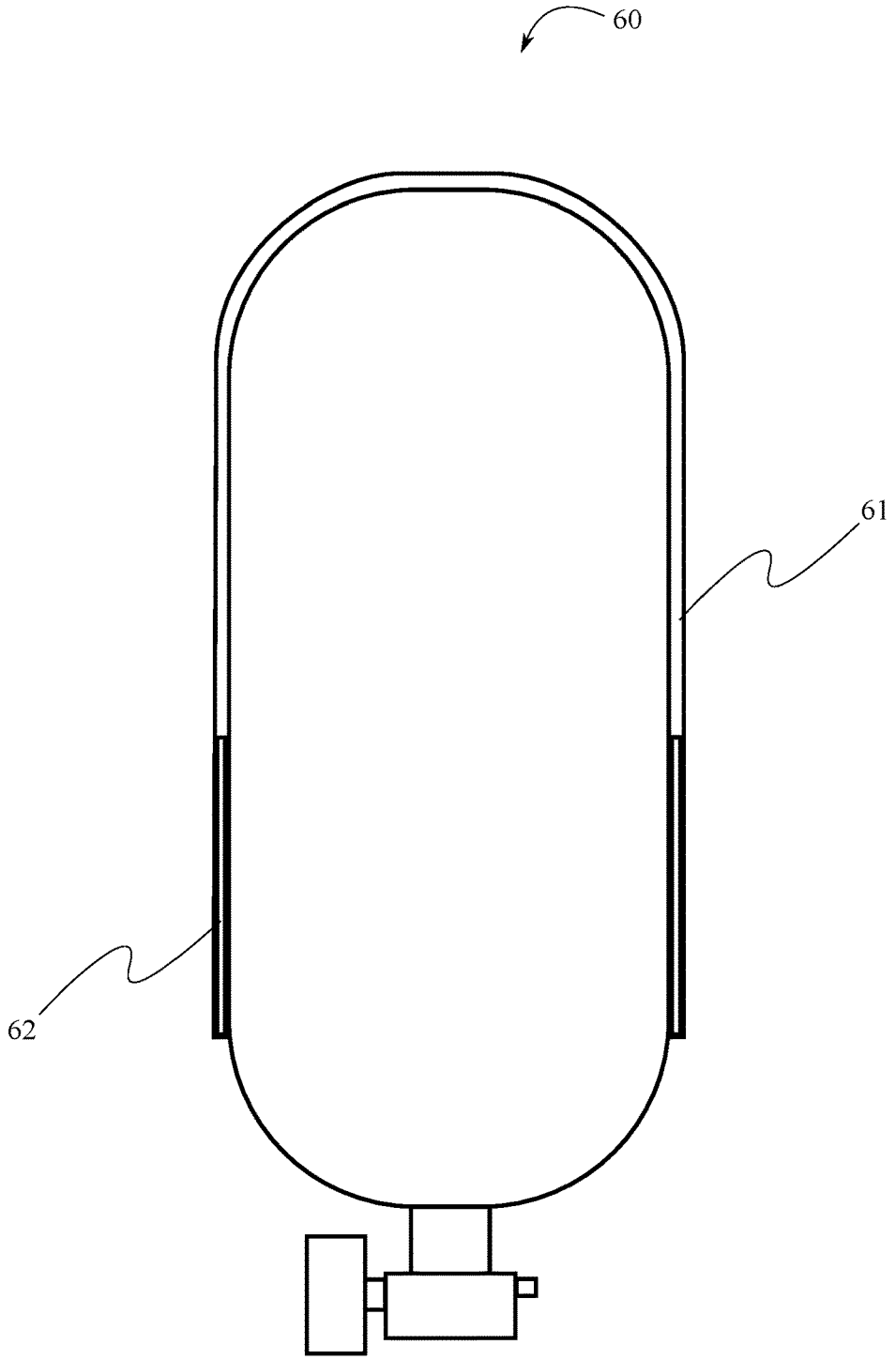
FIG. 16 is a sectional view, showing the elastic band integrated into the tank sleeve.

In reference to FIG. 15, the SCBA cylinder wrap 60 encases and protects the SCBA tank. The SCBA cylinder wrap 60 comprises a tank sleeve 61, an elastic band 62, and a reflective surface 70. The tank sleeve 61 is a single opening enclosure that is slipped around the SCBA tank. In reference to FIG. 16, the elastic band 62 is integrated into the tank sleeve 61, wherein the elastic band 62 ensures that the tank sleeve 61 is tightly held in place around the SCBA tank. The elastic band 62 may be integrated around just the opening of the tank sleeve 61, or throughout the entire body of the tank sleeve 6.

In reference to FIG. 15, the reflective surface 70 of the SCBA cylinder wrap 60 is externally disposed on the tank sleeve 61, such that the reflective surface 70 of the SCBA cylinder wrap 60 faces outwards, away from the SCBA tank when the tank sleeve 61 is positioned around the SCBA tank. The reflective surface 70 of the SCBA cylinder wrap 60 acts to reflect light that is directed at the user in order to make the location of the user more apparent; particularly in low visibility environments. Preferably, the reflective surface 70 of the SCBA cylinder wrap 60 is a reflective tape that is adhered to the tank sleeve 61. However, it is possible for the reflective surface 70 of the SCBA cylinder wrap 60 to be connected to the tank sleeve 61 using a different fastening means, or integrated into the tank sleeve 61 at the time of manufacture. The reflective surface 70 of the SCBA cylinder wrap 60 can be configured in a variety of different colors.

In further reference to FIG. 15, in some embodiments of the present invention, the SCBA cylinder wrap 60 further comprises a light assembly 50. The light assembly 50 of the SCBA cylinder wrap 60 is integrated into the tank sleeve 61 and provides an additional means of increasing the visibility of the user. The light assembly 50 of the SCBA cylinder wrap 60 comprises a light source 51 and a dual-domain power supply 52. The light source 51 of the SCBA cylinder wrap 60 is externally integrated into the tank sleeve 61, such that the light source 51 faces outwards, away from the SCBA tank. The light source 51 of the SCBA cylinder wrap 60 is electrically connected to the dual-domain power supply 52 of the SCBA cylinder wrap 60, as depicted in FIG. 18, wherein the dual-domain power supply 52 of the SCBA cylinder wrap 60 directs current from one of two power sources to the light source 51 of the SCBA cylinder wrap 60. In one embodiment, the light source 51 of the SCBA cylinder wrap 60 is a single light emitting diode (LED), while in another embodiment, the light source 51 of the SCBA cylinder wrap 60 is a plurality of LEDs. However, the light source 51 of the SCBA cylinder wrap 60 is not limited to the use of LEDs and may be any other source of electrically produced illumination.

The dual-domain power supply 52 of the SCBA cylinder wrap 60 allows current to be derived from one of two sources: a battery pack or the extant SCBA power supply. The dual-domain power supply 52 of the SCBA cylinder wrap 60 is internally integrated into the tank sleeve 61, in addition to the battery pack. The battery pack may be either a replaceable battery pack or a rechargeable battery pack. In embodiments where the battery pack is a rechargeable battery pack, a charging port is integrated into the tank sleeve 61. The dual-domain power supply 52 of the SCBA cylinder wrap 60 may be configured to manually switch between the power sources through the use of a switch integrated into the tank sleeve 61, or automatically switch between the power sources through the use of an intelligent switching circuit. The intelligent switching circuit selects an alternative power source, if the main power source is absent or drops below a critical voltage level. Preferably, the power source switching of the intelligent switching circuit is performed with advanced metal-oxide-semiconductor field-effect transistors (MOSFETs), to ensure very low power loss.

In some embodiments, the light source 51 of the SCBA cylinder wrap 60 may be normally in a powered off state, wherein the light source 51 of the SCBA cylinder wrap 60 is powered on via an encrypted radio frequency link. In such embodiments, the light assembly 50 of the SCBA cylinder wrap 60 further comprises a transceiver 53 that is electrically connected to the dual-domain power supply 52 of the SCBA cylinder wrap 60, as depicted in FIG. 18. In one configuration, an activation signal is transmitted from a remote device using the encrypted radio frequency link. Upon receiving the activation signal through the transceiver 53 of the SCBA cylinder wrap 60, the dual-domain power supply 52 of the SCBA cylinder wrap 60 is instructed to supply current to the light source 51 of the SCBA cylinder wrap 60. In another configuration, the transceiver 53 of the SCBA cylinder wrap 60 and the remote device continuously maintain the encrypted radio frequency link, wherein the dual-domain power supply 52 of the SCBA cylinder wrap 60 is programmed to supply current to the light source 51 of the SCBA cylinder wrap 60 if the encrypted radio frequency link is interrupted or lost for a defined period of time.

Although the invention has been explained in relation to its preferred embodiment, it is to be understood that many other possible modifications and variations can be made without departing from the spirit and scope of the invention as hereinafter claimed.

What is claimed is:

1. A self-contained breathing apparatus (SCBA) strap wrap comprises:

a backing;

a front encasement;

a reflective surface;

the front encasement being adjacently connected to the backing along a first longitudinal edge and a second longitudinal edge of the backing;

the front encasement and the backing forming a strap receiving channel having a first opening and a second opening positioned opposite each other along the first longitudinal edge and the second longitudinal edge; and the reflective surface being disposed on the front encasement opposite the backing.

2. The SCBA strap wrap as claimed in claim 1 comprises:

the backing comprising a first flap and a second flap;

the first longitudinal edge being positioned along the first flap;

the second longitudinal edge being positioned along the second flap; and the first flap being selectively engaged with the second flap.

3. The SCBA strap wrap as claimed in claim 1 comprises:

the front encasement comprising a first section and a second section; and the first section being offset from the second section.

4. The SCBA strap wrap as claimed in claim 3 comprises:

a light assembly;

the light assembly being integrated into the first section; and the reflective surface being disposed on the second section.

5. The SCBA strap wrap as claimed in claim 1 comprises:
a light assembly comprising a light source and a dual-domain power supply;
the light source being integrated into the front encasement opposite the backing; and
the light source being electrically connected to the dual-domain power supply.

6. The SCBA strap wrap as claimed in claim 1 comprises:
the front encasement comprising a first buckle slot and a second buckle slot; and
the first buckle slot and the second buckle slot being terminally positioned opposite each other.

7. The SCBA strap wrap as claimed in claim 1 comprises:
the reflective surface being disposed on the first reinforced section and the second reinforced section.

8. A self-contained breathing apparatus (SCBA) wrap system comprises:
a plurality of SCBA strap wraps each comprising a backing, a front encasement, and a reflective surface;
the front encasement being adjacently connected to the backing along a first longitudinal edge and a second longitudinal edge of the backing;
the front encasement and the backing forming a strap receiving channel having a first opening and a second opening positioned opposite each other along the first longitudinal edge and the second longitudinal edge;
the reflective surface being disposed on the front encasement opposite the backing;
a SCBA cylinder wrap comprising a tank sleeve, an elastic band, and a reflective surface;
the elastic band being integrated into the tank sleeve;
the reflective surface being externally disposed on the tank sleeve; the plurality of SCBA strap wraps comprising a lumbar wrap; the front encasement of the lumbar wrap comprising a first reinforced section, a second reinforced section, and a SCBA frame indentation; and the SCBA frame indention being positioned in between the first reinforced section and the second reinforced section.

9. The SCBA wrap system as claimed in claim 8 comprises:
the backing comprising a first flap and a second flap;
the first longitudinal edge being positioned along the first flap;
the second longitudinal edge being positioned along the second flap; and
the first flap being selectively engaged with the second flap.

10. The SCBA wrap system as claimed in claim 8 comprises:
the plurality of SCBA strap wraps comprising a shoulder wrap;
the front encasement of the shoulder wrap comprising a first section and a second section; and
the first section being offset from the second section.

11. The SCBA wrap system as claimed in claim 10 comprises:
the shoulder wrap comprising a light assembly;
the light assembly being integrated into the first section; and
the reflective surface being disposed on the second section.

12. The SCBA wrap system as claimed in claim 8 comprises:
each of the plurality of SCBA strap wraps further comprising a light assembly;
the light assembly comprising a light source and a dual-domain power supply;
the light source being integrated into the front encasement opposite the backing; and
the light source being electrically connected to the dual-domain power supply.

13. The SCBA wrap system as claimed in claim 8 comprises:
the plurality of SCBA strap wraps comprising a lumbar wrap;
the front encasement of the lumbar wrap comprising a first buckle slot and a second buckle slot; and
the first buckle slot and the second buckle slot being terminally positioned opposite each other.

14. The SCBA wrap system as claimed in claim 8 comprises:
the reflective surface being disposed on the first reinforced section and the second reinforced section.

15. The SCBA wrap system as claimed in claim 8 comprises:
the SCBA cylinder wrap further comprising a light assembly;
the light assembly comprising a light source and a dual-domain power supply;
the light source being externally integrated into the tank sleeve; and
the light source being electrically connected to the dual-domain power supply.

16. The SCBA wrap system as claimed in claim 8 comprises:
each of the plurality of SCBA strap wraps being a wrap selected from the group consisting of a shoulder wrap, a lumbar wrap, and a cylinder retention wrap.

* * * * *